US005931763A

United States Patent [19]

Alessandri

[11] Patent Number: 5,931,763

[45] Date of Patent: Aug. 3, 1999

[54] SYSTEM FOR PROGRAMMING TRAINING ON EXERCISE APPARATUS OR MACHINES AND RELATED METHOD

[75] Inventor: Nerio Alessandri, Longiano, Italy

[73] Assignee: Technogym S.r.l., Gambettola, Italy

[21] Appl. No.: 09/028,673

[22] Filed: Feb. 24, 1998

Related U.S. Application Data

[63] Continuation-in-part of application No. 08/539,408, Oct. 5, 1995, Pat. No. 5,782,720.

[51] Int. Cl.[6] ..... A63B 21/00

[52] U.S. Cl. ..... 482/4; 482/5; 482/900; 482/902

[58] Field of Search ..... 482/1–9, 900–902, 482/903, 51, 52, 54, 57

[56] References Cited

U.S. PATENT DOCUMENTS

| | | | |
|---|---|---|---|
| 4,817,940 | 4/1989 | Shaw et al. | 482/9 |
| 5,213,555 | 5/1993 | Hood et al. | 482/902 X |
| 5,230,673 | 7/1993 | Meyama et al. | 482/902 X |

*Primary Examiner*—Glenn E. Richman

*Attorney, Agent, or Firm*—Pillsbury Madison & Sutro LLP

[57] ABSTRACT

A system for programming training on exercise apparatus, with a series of exercises defining a personalized program, includes a central unit with first processor and a bi-directional data transferor; a portable medium, with a portable memory for data storage; a plurality of stations, not connected to one another by a data transmission line, and located at the exercise apparatus, with a second processor and a bi-directional data transferor from and to the portable medium, so as to receive as input the data in the portable memory relative to the exercise to be performed on an individual apparatus, for programming the apparatus, and so as to transfer as output to the portable memory upon completion of the exercise, data relative to the performance of the exercise so as to allow such data to be controlled. The first processor, after receiving from the portable medium the actual data for an exercise just completed, through the bi-directional data transferor of the said central unit, being capable of modifying the program in accordance with the actual data received.

The central unit has data storage and/or comparator means, connected to the first processor, or the plurality of stations have data storage and/or comparator means, connected to the second processor, in order to allow the use of specific data.

44 Claims, 3 Drawing Sheets

SYSTEM FOR PROGRAMMING TRAINING ON EXERCISE APPARATUS OR MACHINES AND RELATED METHOD

This is a Continuation-in-Part of National Appln. No. 08/539,408 filed Oct. 5, 1995, now U.S. Pat. No. 5,782,720.—(M#221205), allowed.

BACKGROUND OF THE INVENTION

The present invention relates to a system for programming training on exercise apparatus.

In particular, the system disclosed can be used to advantage in sportrecreational structures such as gymnasiums, fitness centers, sports clubs, rehabilitation centers, clinics and similar locations.

In such structures (for the purpose of simplicity hereinafter referred to as gyms), users are supposed to perform a series of exercises or rehabilitative movements differentiated according to parameters relative to the type of training or rehabilitation, the user's physique and state of health, the objectives to be reached, etc.; in practice, a program of this kind defines a daily routine protocol which, in most cases, will vary in time in accordance with the athlete's achievements.

Each user or athlete is assigned a specific program to be followed during the various training sessions. The programs differ according to the number of exercises, the order in which they are to be performed, their repeatability, length and intensity.

To this end, at the gym, once the instructor has evaluated the athlete's physical characteristics and the objectives to be reached, he or she prepares an exercise "routine", clearly indicating to the athlete the way in which these exercises must be performed.

The resulting routine is the athlete's program, and is accompanied by a written schedule which the athlete must carry during training for the necessary consultation during performance of the exercises.

The programs normally prepared relate to lengthy periods of attendance at the gym and, in any case, cannot be altered upon each visit for obvious organizational reasons, so that, in brief, for each cycle the athlete substantially repeats the same exercises.

The program is generally set as a kind of average between the initial training stage (during which the athlete is more likely to be less trained) and the final result for each cycle.

For this reason, it is possible that during the initial stage the athlete trains more intensively than necessary, while during the final stage of each cycle, the exercises do not stretch the athlete's actual physical abilities to the full. With programs of this type it is, therefore, impossible to constantly correlate the intensity of the training and the athlete's actual condition.

This is of fundamental importance, since training which is hyper or hypo intensive may not be of use to the athlete and, in some cases, may even have negative consequences.

Exercise machines are currently available which are able to interact with feedback from the athlete relative to the latter's physiological parameters (e.g.: heart rate), varying the intensity of an exercise in accordance with the feedback. However, the repeated use of such machines does not provide identical results.

Moreover, there is no link between exercises performed on different machines, because it is impossible to compare the data relative to exercises performed on more than one machine.

At present, it is impossible to prepare a program for a series of exercises based on the athlete's actual reactions to the training, relative to the exercise and physical effort involved.

This is particularly true if considered in relation to the large number and variety of machines which the athlete has to use when following a routine protocol, passing from stations with cardiovascular machines (bikes, treadmills, steps) to those with isokinetic machines (benches, etc). In most gyms, these machines are all separate units in that there is no way of connecting them up, for example, in an interactive data network enabling them to communicate in real time with one another and with a server capable of recording and processing the data for the exercises completed and providing a report on the status of an individual user. Attempts have been made to achieve this sort of connection, using known networking techniques based on a central unit or server and peripheral units or personal computers. All these attempts envisage the establishment of a network of cables to physically connect all the machines concerned to one another, this solution, however, having proved decidedly unworkable considering the nature of the places of installation (gyms) and the fact that the machines to be connected are invariably scattered in all the furthest corners of the gym, not to mention that this type of connection is ill-adapted to gym machines and working conditions, network links being easily lost, as users of this kind of system well know.

SUMMARY OF THE INVENTION

The object of the present invention is to overcome the afore-mentioned disadvantages with a system for programming training on exercise apparatus, designed to provide a training or rehabilitation program which may be varied in accordance with the results achieved, that is to say, according to the performance of the various series of exercises to be performed during training sessions. The system of the present invention, in a preferred implementation, may be accurately defined as a centralized system for the management of routine protocols. It permits a "virtual connection" to be made between all the machines present in a gym and a central unit for the programming of the training to be effected, and it allows the storage and even a graphic display of previous training.

The connection is defined as "virtual" because it is established without the use of network cables or transmission lines which would create a potential hazard on the gym premises: in other words, all the machines remain entirely separate and independent of one another.

The system of the present invention includes a central unit for the development of a training program to be performed on a plurality of exercise apparatus, the exercise apparatus possibly having a plurality of stations to allow the exercises to be set on them, as well as to receive feedback relative to the exercises performed.

The interface between the central unit and the stations is constituted by a data storage device consisting of a contact-free, portable memory contained in a medium designed to interact with the central unit and stations with suitable bi-directional data transmission means.

The use of the portable memory as the training program's portable medium may also determine various means of access to other activities linked to the gym or sports center. For example, the portable memory may be used to control access, as a means of payment, as a key for library references, to check attendance, etc.

The use of a contact-free, portable memory known in the trade as SMART KEY, allows the data storage medium to be totally customized, guaranteeing that the machine will be adapted to the requirements of the exercises fully automatically and in the minimum amount of time.

In addition to what has been stated, the present invention may be used to manage exercise apparatus which are not equipped with a computerized programming system, to program activities that are collateral to actual training sessions (as specified in detail further on), to interface exercise apparatus or machines of different types and/or makes, etc. In other words, with the present invention, an instrument that programs training and collateral activities is also provided which is capable of managing all the activities that are practiced at or connected to sports and recreational structures such as gymnasiums, fitness centers, sports clubs, rehabilitation centers, clinics and similar locations.

In relation to what has just been stated on the so-called collateral or complementary training activities, a diet is usually included which is adequate and tailored to the training results to be obtained. In other words, depending on the sport practiced, the time until the next competition, the need to lose or gain weight, etc., each athlete must follow a special diet that facilitates or in any case helps him/her in obtaining results.

With the invention disclosed, it is possible to define diets connected to physical activities performed and to the results to be obtained.

Among the sports activities that form a training program, there are a few which are practiced in areas other than gyms; those types of activities may comprise, for example, running outdoors, swimming or other activities. Up to now, those activities formed part of a program that was separate from the training or rehabilitation programs in the gym; with the present invention, the activities in question may be included in a single training program.

The training session programming system disclosed may also be extended to data relative to other activities or interests connected directly or indirectly to activities in the gym or in similar centers. By way of example, the system disclosed makes it possible to obtain data on the administration of a center, payment of fees, lesson times, etc. Among data contained in this system, one may also use data relative to specialized publications, libraries that cover this sector, etc., so as to provide a more complete service which is also dedicated to theoretic training aspects.

Moreover, the system disclosed may be provided with comparator means equipped with data storage means relative to machines and apparatus of different types or makes so that the exercises may be standardized. In other words, the system disclosed may allow the performance of exercises on machines that utilize different parameters which measure the physical effort exerted, calories used, etc., averaging the relative data received by said machines (or by the users through readings on said machines) in a single protocol so as to allow training sessions to be programmed.

BRIEF DESCRIPTION OF THE DRAWINGS

The technical features of the present invention, in accordance with the above-stated object, and the advantages of the invention are more clearly described in the detailed description below, with reference to the accompanying drawings which illustrate an embodiment by way of example only, and in which.

DESCRIPTION OF THE PREFERRED EMBODIMENTS

With reference to the accompanying drawings, the system for programming training on exercise apparatus of the present invention is of the type which may be used for training or rehabilitation based on the performance, using a plurality of exercise apparatus, of a series of exercises defining a personalized program.

Figure 1:
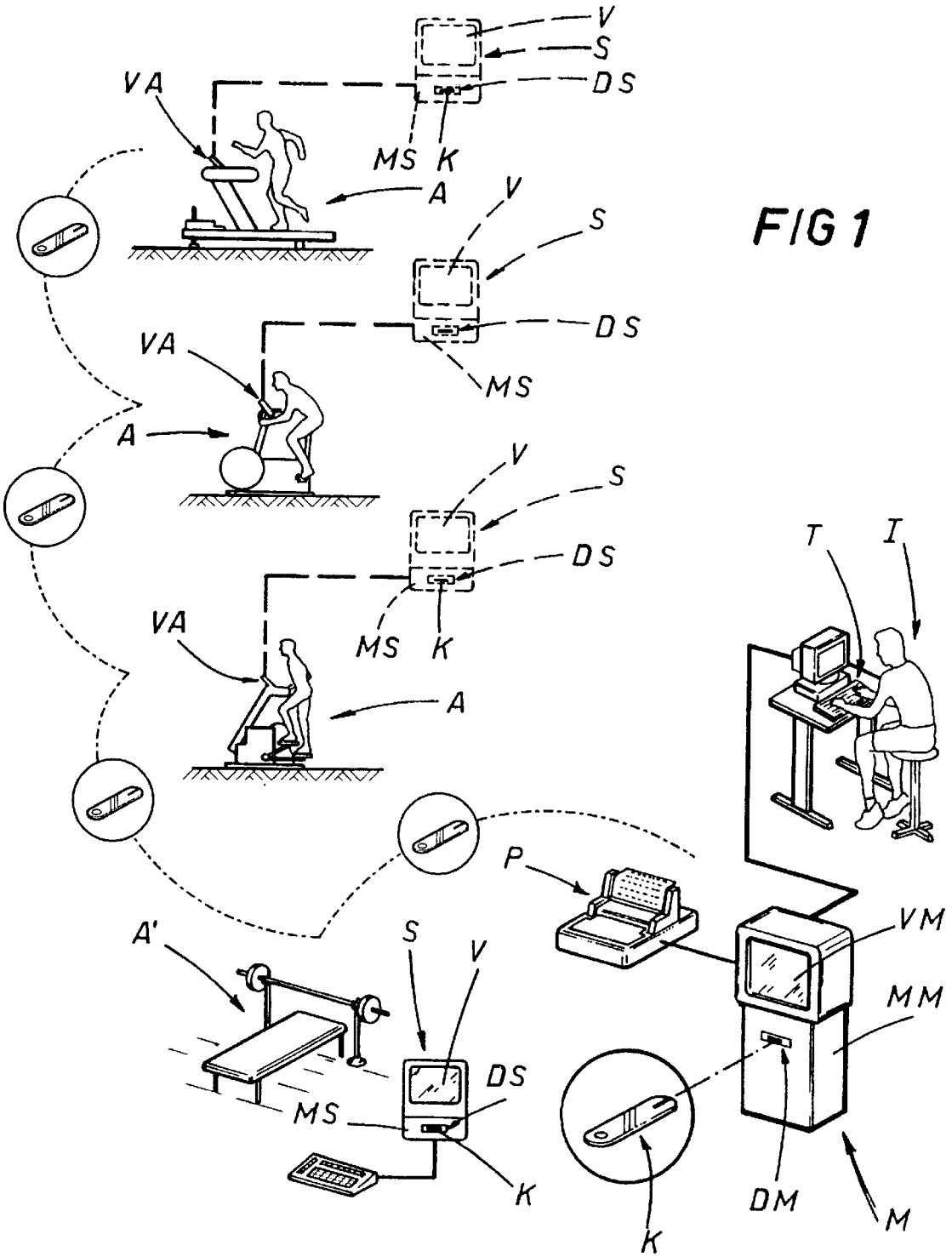
FIG. 1 is a schematic illustration of an embodiment of the present invention.

In FIG. 1, where the various elements of the system are not shown in proportion (for the purpose of greater clarity), such exercise apparatus are schematically represented by machines A for the performance of exercises which may be compared, respectively, to cycling, running, stepping (technically known as bike, jogger or treadmill and step), as well as a conventional bench A' for weight-lifting with a bar.

All these machines are not interconnected in any way, that is to say, there is no form of reciprocal data network connection between them.

The system includes a central unit M with first processing means MM and bi-directional data transfer means DM. The central unit M has means which may be used to write and read data relative to the personalized program, as well as to modify the program itself.

The processing means MM may be a personal computer with suitable software for the programming of personalized training, obviously by trained medical personnel responsible for programming the activities in the gym, the term "programming" being used to mean the defining of the different routine protocols which an athlete must follow during a session and on each single machine. For example, in the case of the bike, the protocol might be defined by a curve in a Cartesian plane where time is measured on the x-axis and any other variable connected with the effort exerted is measured on the y-axis. The bi-directional data transfer means DM, connected to the processing means MM, are suitable devices for writing to and reading from a portable memory, designed to transfer data between units which are not directly connected.

The portable memory is located on a portable medium K and stores the data relative to the aforementioned personalized program.

The system also includes a plurality of stations S, located at the corresponding plurality of exercise apparatus units A, A'.

The stations S, like the central unit, have second processing means MS and means DS for the bi-directional transfer of data from and to the portable medium K, so that they receive, as input, the data present in the memory relative to the exercise to be performed in order to define the programming of the apparatus, and to transfer as output to the portable memory, upon completion of the exercise, the real data for the exercises and for the physical effort exerted so that this data can be checked.

The first processing means and bi-directional data transfer means DM of the central unit can modify the personalized program according to the data received when the exercises are performed.

Obviously, the second processing means MS in the stations S need not process or reset the personalized program, since it is sufficient that they be able to read the data from the portable medium K and transmit to the latter the data relative to the exercises and physical effort exerted.

The central unit M is best installed in an easily accessible area of the gym and may take the form of a multi-media station, of the type used, for example, in arts centers, stations or airports, equipped, for example, with "touch screen" type user interface devices to facilitate reference.

The various exercise apparatus A, A' are not connected directly to the central unit M. This avoids the need for electrical or other connections, allowing the machines to be placed at any distance from the central unit, so that the system can be used in gyms or centers spread over more than one story, or over an extensive area.

The connection between the central unit M and apparatus units A, A', established virtually by means of the portable medium K, may consist of an electronic key K (for example, with an $E^2$PROM type memory) which allows communication between the central unit M and the stations S.

The electronic key K may have a plastic enclosure designed to render it impermeable. The combination of a memory programmed through magnetic induction and a waterproof cover allows, on one hand, memory programming without the need for contacts, and on the other, allows easy use of the electronic key K even in environmental conditions which have negative effects on other program media, e.g., the presence of humidity. The stations S each may have a respective monitor V to display the exercises to be performed, and may vary according to the corresponding machines or apparatus.

For example, exercise machines which require electronic programming (such as the bike, jogging machine and step, denoted by A in FIG. 1) can be linked to stations S connected directly to the controls for the respective apparatus units, or the stations S may form part of those controls. In this way, the apparatus units are "set" directly with the data obtained from the portable memory.

There may also be means which automatically detect the exercise and physical effort exerted, designed to control the exercise and physical effort exerted, providing the respective data as output which may be used by the central unit M.

The displays VA shown provided on the respective exercise apparatus units may be used to display the program instead of the monitors V on the stations S.

In FIG. 1, the stations S linked to electronically programmed exercise apparatus units are shown by respective broken lines, since they may, as described above, be incorporated in the exercise apparatus units.

For the exercise apparatus units which do not require automatic programming, such as the isokinetic machines or weights (in FIG. 1 represented by the bench A'), the data relative to the exercise and physical effort exerted can be entered "manually" using the keyboard T', or using the touch screen type monitor V.

At the central unit M there are manual data entry means T, such as, for example, a keyboard. The keyboard T can be used by the instructor/physician I to provide the first processing means MM (and, therefore, also the bi-directional data transfer means DM) with data about the athlete for the composition of the personalized program.

The description below illustrates some possible ways of using the system disclosed.

The first time a person goes to a gym, or in the event of a periodic review of the program followed so far, following an initial interview with the instructor (accompanied if necessary, by a medical examination) during which the terms and the objectives of the training are established and a routine protocol is defined, the portable memory K is "loaded" with a training schedule defined by the aforementioned data which form a set of instructions that can be read by the stations S positioned at the exercise apparatus units A, A'.

The routine protocols must be followed daily using the gym's exercise apparatus units A, A'. These protocols are entered in the central unit M, which is the database containing all the training protocols of the entire gym. Each individual protocol is divided into single apparatus protocols each dedicated and correlated to the exercise apparatus units A, A' used. During subsequent training sessions, that is, whenever the athlete goes to the gym for a training session, the portable medium K is inserted into the reading device defined by the first bi-directional data transfer means DM so as to receive instructions relative to the training for that particular day.

When the user arrives at an exercise apparatus unit, if it is of the type A, provided with the capability of automatic programming, he/she inserts the electronic key K in the purpose-designed reading device on the station S linked to the exercise apparatus unit, thus "setting" the exercise apparatus unit, so that he/she then simply goes ahead with the training. Upon completion of the training, the station S "unloads" onto the key K the real data for the training just completed and the variations (if any) with respect to that envisaged by the protocol.

In the case of exercise apparatus units with manual programming (see bench A' in FIG. 1) the user inserts the electronic key K into the station S reading device and the monitor V displays the type of exercises, their order, repetitions and relative weights. Upon completion, it is the athlete who must confirm whether the training corresponded to that suggested, or specify any variations, so that all data may be stored on the electronic key K.

In both cases, for exercise apparatus units with automatic or manual control, following storage of data about the exercise and physical effort exerted, the monitor V of the station S may, in one possible embodiment of the invention, display the next exercise to be performed, indicating the most suitable sequence of machines.

At the end of the training session, the individual goes to the central unit M to "unload" the electronic key K and enter in a memory, with first processing means MM, the feedback on the exercise and physical effort exerted.

The final operation may envisage an indication which immediately reveals the quality of the exercise and physical effort exerted, thus providing an assessment of the training session, and which may or may not include a score or "well done" grading comment.

When the data is entered in the central unit, as well as facilitating the management of various schedules for a number of days' training, it is possible to control the training sessions effected by a user, set out timetables, types of exercises, analyze user attendance, etc.

The user interacts with the central unit by means of the electronic key K, as described above, loading the data relative to training and unloading the data about the exercise and physical effort exerted, and may, in some cases, interact using a touch screen type device.

Figure 2:
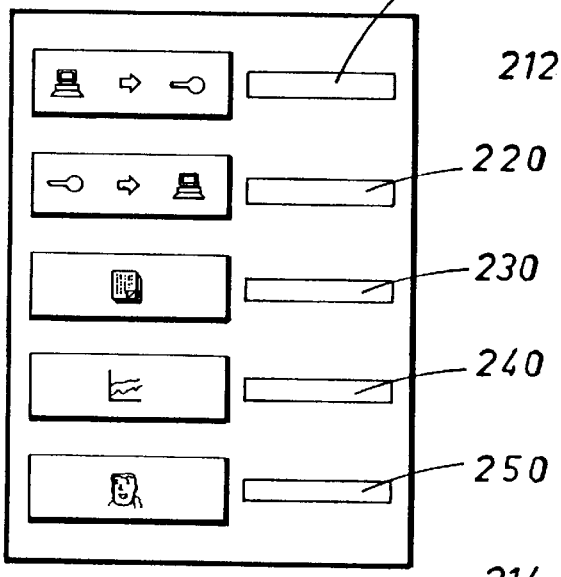
FIGS. 2, 3, 4, 5, 6 and 7 are schematic illustrations of possible graphic representations of the set-up and layout of a training program provided in accordance with the principles of the present invention.

Following the insertion of the electronic key K and/or the pressure of a fingertip on the screen VM (in the case of "touch screen" devices) on the central unit M, a screen page showing the main menu appears, similar to that illustrated in FIG. 2.

The main menu is divided into a series of icons 210, 220, 230, 240, 250 which correspond with the various functions of the main program. When the user touches one of the icons displayed on the screen, the program allows access to the selected environment which is described below.

The last icon or box 250 illustrated in FIG. 2 relates to the programs used only by the instructors to set training routines and enter various data. One of the functions of the main program is the training load program (corresponds to box 210 in FIG. 2), which allows the training to be performed by the user to be loaded onto the electronic key K. The user employs this function each time he/she enters the gym and decides to begin training. While the electronic key K is loaded, the training schedule and/or the user's progress relative to the objective set may appear on the display.

Figure 3:
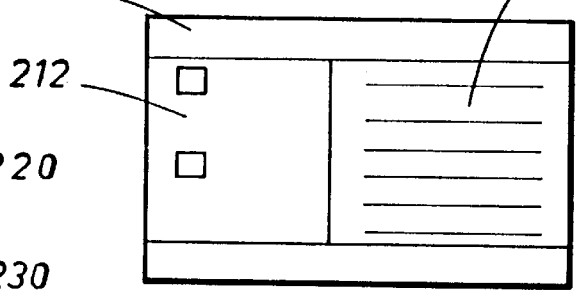

The training schedule may resemble that shown in FIG. 3, where the athlete's name appears in one sector 211 of the screen, while another two sectors 212 and 213 respectively show the various exercises for the training session and the way in which they must be performed.

As well as being displayed on the central unit M screen VM, the training schedule can be printed out as hard copy, by means of a printer P connected to the central unit.

Figure 4:
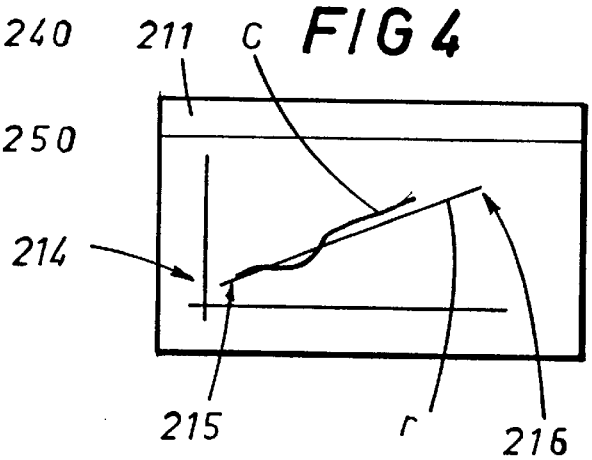

The user's progress may be displayed as shown in FIG. 4, where a graph 214 is used, the X-axis representing the time, and the Y-axis the level of fitness.

On the graph 214, a straight line r connects a first point 215, corresponding to the condition at the start of the training period, and a second point 216, relative to the athlete's ultimate objective. A curve c is superimposed on the straight line r, and shows the athlete's actual progress over the same period of time.

Another function of the main program is the unloading of training data. The user accesses this environment (corresponding to box 220 in FIG. 2) at the end of each training session. During this stage, the results of training, stored by the stations S on the electronic key K, are unloaded to the console and a graph may appear on the screen VM, allowing immediate evaluation of the exercise and physical effort exerted.

Figure 5:
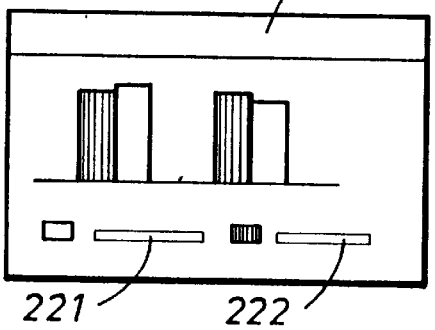

The image may resemble that shown in FIG. 5 and can be displayed using the command denoted by 230 in FIG. 2, which is a training schedule display function.

In FIG. 5, where the athlete's name appears in the top sector 211, the training schedule loaded on the electronic key K is displayed, and for each type of exercise in the schedule (there being two in the example) there is an indication as to whether it has been performed (222) or not (221). The next exercise to be performed may also be indicated. The training schedule may be displayed at any moment and can be printed by the user if so required.

Figure 6:
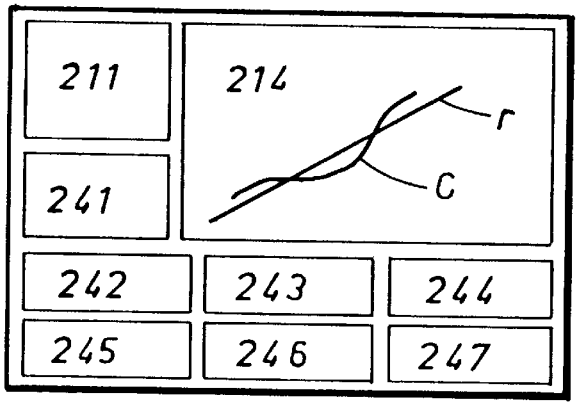

Another option in the main menu is to display the exercise and physical effort exerted by selecting box 240 in FIG. 2, allowing the display of data which has been archived, the image resembling that shown in FIG. 6. The graph 214 on the top right is the same as that in FIG. 4 previously described, which shows the user's progress toward the objective set, with the relative reference straight line r and the curve c showing the actual exercises and physical effort exerted.

The individual's personal name and surname appear in the top left corner of box 211, together with other data such as his/her date of birth and weight. By selecting this icon it is possible to access a window which allows modification of the weight if necessary.

Box 241, lower down, is available for user information.

The remaining icons 242, 243, 244, 245, 246, 247 can be used to display data relative to the various exercises performed, or for various kinds of comparisons.

For example, boxes 242, 243, 244, 245 and 246 may display, respectively, the kilometers totaled on the "bike", the total number of floors covered on the "step", the kilometers totaled on the "jogging machine", the total kilograms lifted on isokinetic machines, and the total kilo calories used.

Figure 7:
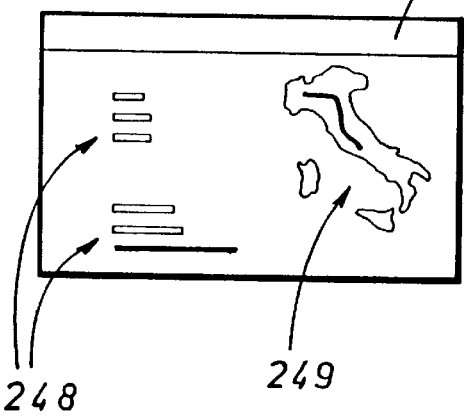

When an icon is selected, a screen page appears, showing the relative data with graphics similar to those illustrated in FIG. 7, for example, for "bike" training.

Similarly to the illustrations in FIGS. 3, 4 and 5, the graphics in FIG. 7 show the athlete's name at the top in area 211, while the kilometers totaled during training are shown at the side in area 248, these kilometers being divided into training periods, there being, at the side, a graphic indication in area 249 of the kilometers totaled relative to a known reference value (e.g.: a map of Italy, upon which the kilometers totaled are shown by a line starting at a known location).

Box 247, for comparisons, allows the graphic comparison of the user's performance relative to all other members of the gym and/or a given reference group.

Obviously, as already stated, the present description illustrates only some of the possible uses of the system disclosed, without limiting other possible applications which may be obtained through modification of the main program software, or the possibilities offered by the menu.

We have defined the portable medium K as a contact-free data storage means and, in the simplest embodiment of the present invention, it is an electromagnetically activated permanent memory (with high capacity in relation to size, for example 2 Kbytes). In another embodiment, it might be an infrared transponder or another equivalent unit.

Basically, the system described above defines a new method for the management of gym apparatus which do not require a data network connection but which are "virtually connected" to one another through the contact-free programmable key K. This method may be summarized as follows:

a) a personalized program is created on a central unit M equipped with first data processing means MM for defining a series of routine protocols, each of which is related to a plurality of apparatus protocols correlated to the exercise to be performed on the said exercise apparatus and/or machines;

b) one of the routine protocols forming part of the personalized program is transferred by the bi-directional data transfer means DM in the central unit M, to a portable medium K constituting a contact-free data storage means having a portable memory designed to hold the data;

c) one of the said apparatus protocols is then transferred from the said portable medium K to one of the stations in the plurality of stations S, independent of one another, i.e., not connected in a data network, at one of the exercise apparatus A, A', each of the stations being equipped with second processing means MS and bi-directional data transfer means DS; the transfer from the portable medium K to the second processing means MS being such that the latter receive as input the data stored by the portable medium relative to the apparatus protocol to be followed on that machine in order to program the related apparatus;

d) the user performs the programmed training;

e) upon completion of the training, the real data relative to the performance of the apparatus protocol correlated to the exercise is transferred from the portable memory K to the second processing means MS;

f) steps c) d) and e) are repeated for each of the remaining exercise apparatus, that is to say, for each of the remaining correlated apparatus protocols;

g) the real data for the correlated apparatus protocols completed, i.e., the data for the entire routine protocol really completed, is transferred by the bi-directional data transfer means DM from the portable memory K to the central unit M;

h) the central unit M processes the real data for all the correlated apparatus protocols completed and, if necessary, modifies the personalized program, i.e., the series of routine protocols, accordingly.

Figure 8:
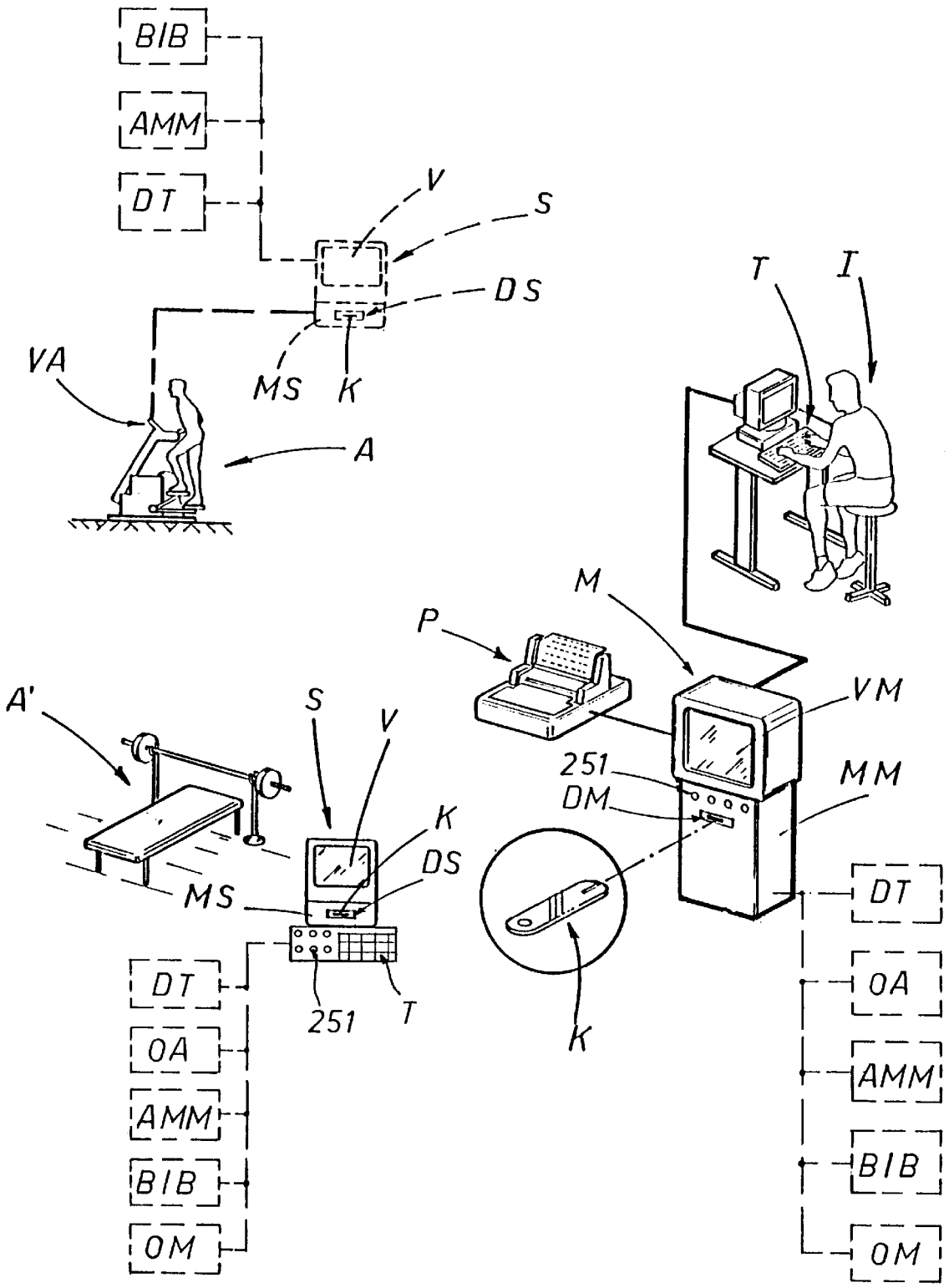
FIG. 8 is a schematic illustration of another embodiment of a system for programming training on exercise apparatus and machines disclosed.

Another embodiment of a system for programming training sessions in accordance with the present invention is schematically represented in FIG. 8.

In this embodiment, the processing means MM on the central unit M are also equipped with data storage means, that is, with a resident memory which contain various types of data (stored information and/or software), as described below.

As in the other embodiments, bi-directional data transfer means DM have been envisaged to interact with the portable medium K in the same way as described previously.

Thanks to the special equipment of central unit M, the system may be utilized in different ways, for example, using the keyboard T or one or more buttons 251 on the central unit M.

As mentioned previously, among the so-called collateral or complementary training activities, a diet that is adequate and tailored to the results to be obtained is usually included. Programs designed to define diets may be envisaged among the data that can be processed by the appropriate means MM. In FIG. 8 the programs or data are represented by block DT. In practice, according to the data entered using the keyboard T (or buttons 251), or received by the portable medium K, the system disclosed is able to determine the diet. Not only are the data displayed on monitor V, but they may also be reproduced by a printer P. In addition to the age, weight and physical characteristics of the person for whom the diet is to be set, the system processes data relative to physical activity actually performed by the person and can appropriately integrate the diet with physical exercises to be followed.

As mentioned previously, among the sports activities that are part of a training program, there are a few which are practiced in areas other than the gym; these types of activities may include, for example, running outdoors, swimming or other activities. Using the keyboard T, or the buttons 251, data regarding which of these activities is being performed (or is to be performed) can be entered in the central unit M so as to integrate the gym program with the activities in question. This system feature is schematically represented by block OA in FIG. 8 which specifically corresponds to data and/or programs related to the activities. Obviously, data relative to other activities OA may also be utilized in programming the afore-mentioned diets DT.

Moreover, the training session programming system disclosed may also be extended to data relative to other activities or interests connected directly or indirectly to activities in the gym or in similar centers. By way of example, the system disclosed allows data on the administration of a center, payment of fees, lesson times, etc. (schematically represented by block AMM) to be obtained. Among the data and/or programs contained in this system, one may also use data relative to specialized publications, libraries that cover this sector, etc. (schematically represented by block BIB).

Lastly, the system disclosed may be provided with comparator means equipped with data storage means relative to machines and apparatus of different types or makes so that the exercises may be standardized. The comparator means are schematically represented by block OM. Thanks to the presence of the comparator means OM, it is possible to utilize data relative to machines that use different parameters (for example, to measure the physical effort exerted, calories used, etc. as mentioned previously) in order to determine a single training program or to set a diet. Data relative to exercises performed (or to be performed) on exercise machines and apparatus of other types or makes may be entered through readings effected by the user on said machines or in other ways.

The possibility of expanding the training session programming capacity is also extended to stations S, in ways that may differ from one station to another.

In particular, for stations linked to electronically programmed machines, the second processing means MS may be equipped with data storage means relative to diets DT, administrative data AMM and library data BIB; in this way, with the portable medium K, in addition to presetting the machine A for the exercise, and storing the exercise performed on medium K (as previously described), diet, administrative or library data may be obtained.

In relation to the stations linked to machines that do not contemplate automatic programming (such as bench A'), station S may include, as shown in FIG. 8, processing means MS designed to manage data and programs relative to diet DT, other activities OA, administrative data AMM, library BIB, or correlation means with machines of other types or makes OM.

In practice, station S located at the corresponding machine A' that cannot be automatically programmed, or located next to machines of this sort, may be utilized as described below once the portable medium K has been inserted into the reading device DS (bi-directional data transfer means). It allows the training program to be learned and enter the data relative to the effort exerted to be entered, similarly to what was stated for the embodiment shown in FIG. 1.

It displays diets (DT) or administrative (AMM) and/or library (BIB) data on the monitor V.

It allows the user to enter, using the keyboard T or buttons 251 or touch screen buttons on monitor V, the data relative to collateral activities performed (OA), if any, or data relative to exercises performed on machines of other types or makes.

In cases in which the user enters data, the portable medium K, once it has been inserted into the central unit M again, can be used to change the programming for the subsequent exercises and/or the diet.

If there is an interaction with machines of other types and/or makes, these may be cardiovascular or isokinetic machines. In other words, with the present system different types of data may be entered in the training program even without using the portable medium to transfer data. In practice, if isokinetic apparatus or machines are used (that is to say, not managed by a computer), the data corresponding to the number of repetitions, the relative weight, the number of routines, etc. is entered by keys or keyboard (at the central unit or at the peripheral stations or both); in relation to the so-called cardiovascular machines, the data to be entered may be relative to other parameters, such as, for example, the average exercise frequency, distance covered, step, calories used, etc. The data, which may be provided by displays envisaged on the aforementioned cardiovascular machines, is substantially entered manually by the user (or by an instructor) and then filed or in any case utilized by the training program.

Because the word apparatus is used as both a singular and a plural in contemporary American English, and because all machines are commonly understood to be apparatus, but not all apparatus are commonly understood to be machines, the term exercise apparatus unit has been used herein to generically designate respective the apparatus collocated with each station.

Obviously, as already stated, the present description illustrates only some of the possible uses of the system disclosed, without limiting other possible applications which may be obtained through modification of the main program software, or the possibilities offered by the menu.

The present invention, thus designed for the stated object, may be subject to numerous variations, all encompassed by the original design concept, and all components may be replaced with technically equivalent parts.

What is claimed:

1. A system for providing programmed training on exercise apparatus, comprising:

a plurality of exercise apparatus units disposed at respective exercising sites;

a portable medium having a portable memory for storing instructions and performance data relative to a personalized program which includes a series of exercises performed or to be performed by a respective user by use of said exercise apparatus units;

a central unit disposed at a site remote from said exercising sites and operative independently of said exercise apparatus unit, said central unit having a first processor, and a first bi-directional data transfer means operatively associated with said first processor, for writing and reading data relative to said personalized program, and for initiating and modifying the instructions of said program; said first bi-directional data transfer means being arranged to read data from and write data to said portable memory upon occurence of removable association of said portable medium with said first bi-directional data transfer means;

a plurality of stations, each collocated with a respective one of said exercise apparatus units;

each of said stations including a second processor and a second bi-directional data transfer means operatively associated with the respective said second processor, for writing and reading data relative to said personalized program; each said second bi-directional data transfer means being arranged to read instruction data from and write performance data to said portable memory relative to each respective said exercise apparatus unit upon occurrence of removable association of said portable medium with the respective said second bi-directional data transfer means, for providing as input to the respective station instruction data present in the portable memory relative to the exercise to be performed by the user using the respective said exercise apparatus unit collocated with the respective station and for receiving as output from the respective second processor performance data relative to an exercise completed by the user using the respective exercise apparatus unit collocated with the respective said station;

said first processing means being arranged to modify said instruction data in reaction to said performance data output, as transferred to said first processor by removable association of said portable medium with said first bi-directional data transfer means; and said portable medium being arranged to be operatively and physically disconnected from said first bi-directional data transfer means when operatively removably associated with any said second bi-directional data transfer means, and to be operationally and physically disconnected from all said second bi-directional data transfer means when operationally removably associated with said first bi-directional data transfer means, and said central unit also having data storage means connected to said first processing means.

2. The system of claim 1, wherein:

said data storage means are arranged for setting of a diet.

3. The system of claim 1, wherein:

said data storage means comprise administrative data.

4. The system of claim 1, wherein:

said data storage means comprise library data.

5. A system for providing programmed training on exercise apparatus, comprising:

a plurality of exercise apparatus units disposed at respective exercising sites;

a portable medium having a portable memory for storing instructions and performance data relative to a personalized program which includes a series of exercises performed or to be performed by a respective user by use of said exercise apparatus units;

a central unit disposed at a site remote from said exercising sites and operative independently of said exercise apparatus unit, said central unit having a first processor, and a first bi-directional data transfer means operatively associated with said first processor, for writing and reading data relative to said personalized program, and for initiating and modifying the instructions of said program; said first bi-directional data transfer means being arranged to read data from and write data to said portable memory upon occurence of removable association of said portable medium with said first bi-directional data transfer means;

a plurality of stations, each collocated with a respective one of said exercise apparatus units;

each of said stations including a second processor and a second bi-directional data transfer means operatively associated with the respective said second processor, for writing and reading data relative to said personalized program; each said second bi-directional data transfer means being arranged to read instruction data from and write performance data to said portable memory relative to each respective said exercise apparatus unit upon occurrence of removable association of said portable medium with the respective said second bi-directional data transfer means, for providing as input to the respective station instruction data present in the portable memory relative to the exercise to be performed by the user using the respective exercise apparatus unit collocated with the respective said station and for receiving as output from the respective second processor performance data relative to an exercise completed by the user using the respective exercise apparatus unit collocated with the respective station;

said first processing means being arranged to modify said instruction data in reaction to said performance data output, as transferred to said first processor by removable association of said portable medium with said first bi-directional data transfer means; and said portable medium being arranged to be operatively and physically disconnected from said first bi-directional data transfer means when operatively removably associated with any said second bi-directional data transfer means, and to be operationally and physically disconnected from all said second bi-directional data transfer means when operationally removably associated with said first bi-directional data transfer means, and characterized in that the said central unit also has data storage and/or comparator means, connected to said first processing means.

6. The system of claim 5, wherein:

said at least one of data storage and comparator means is or are for using data relative to complementary activities in setting said personalized program.

7. The system of claim 5, wherein:

said at least one of data storage and comparator means is or are arranged, in setting said personalized program, for using data relative to exercises performed on apparatus which utilize a plurality of parameters.

8. A system for providing programmed training on exercise apparatus, comprising:

a plurality of exercise apparatus units disposed at respective exercising sites;

a portable medium having a portable memory for storing instructions and performance data relative to a personalized program which includes a series of exercises performed or to be performed by a respective user by use of said exercise apparatus units;

a central unit disposed at a site remote from said exercising sites and operative independently of said exercise apparatus unit, said central unit having a first processor, and a first bi-directional data transfer means operatively associated with said first processor, for writing and reading data relative to said personalized program, and for initiating and modifying the instructions of said program; said first bi-directional data transfer means being arranged to read data from and write data to said portable memory upon occurence of removable association of said portable medium with said first bi-directional data transfer means;

a plurality of stations, each collocated with a respective one of said exercise apparatus units;

each of said stations including a second processor and a second bi-directional data transfer means operatively associated with the respective said second processor, for writing and reading data relative to said personalized program; each said second bi-directional data transfer means being arranged to read instruction data from and write performance data to said portable memory relative to each respective said exercise apparatus unit upon occurrence of removable association of said portable medium with the respective said second bi-directional data transfer means, for providing as input to the respective station instruction data present in the portable memory relative to the exercise to be performed by the user using the respective exercise apparatus unit collocated with the respective said station and for receiving as output from the respective second processor performance data relative to an exercise completed by the user using the respective exercise apparatus unit collocated with the respective said station;

said first processing means being arranged to modify said instruction data in reaction to said performance data output, as transferred to said first processor by removable association of said portable medium with said first bi-directional data transfer means; and said portable medium being arranged to be operatively and physically disconnected from said first bi-directional data transfer means when operatively removably associated with any said second bi-directional data transfer means, and to be operationally and physically disconnected from all said second bi-directional data transfer means when operationally removably associated with said first bi-directional data transfer means; and said plurality of stations also having respective data storage means connected to respective said second processing means.

9. The system of claim 8, wherein:

said data storage means are arranged for obtaining of data relative to a diet.

10. The system of claim 8, wherein:

said data storage means comprise administrative data.

11. The system of claim 8, wherein:

said data storage means comprise library data.

12. A system for providing programmed training on exercise apparatus, comprising:

a plurality of exercise apparatus units disposed at respective exercising sites;

a portable medium having a portable memory for storing instructions and performance data relative to a personalized program which includes a series of exercises performed or to be performed by a respective user by use of said exercise apparatus units;

a central unit disposed at a site remote from said exercising sites and operative independently of said exercise apparatus unit, said central unit having a first processor, and a first bi-directional data transfer means operatively associated with said first processor, for writing and reading data relative to said personalized program, and for initiating and modifying the instructions of said program; said first bi-directional data transfer means being arranged to read data from and write data to said portable memory upon occurence of removable association of said portable medium with said first bi-directional data transfer means;

a plurality of stations, each collocated with a respective one of said exercise apparatus units;

each of said stations including a second processor and a second bi-directional data transfer means operatively associated with the respective said second processor, for writing and reading data relative to said personalized program; each said second bi-directional data transfer means being arranged to read instruction data from and write performance data to said portable memory relative to each respective said exercise apparatus unit upon occurrence of removable association of said portable medium with the respective said second bi-directional data transfer means, for providing as input to the respective station instruction data present in the portable memory relative to the exercise to be performed by the user using the respective exercise apparatus unit collocated with the respective said station and for receiving as output from the respective second processor performance data relative to an exercise completed by the user using the respective exercise apparatus unit collocated with the respective said station;

said first processing means being arranged to modify said instruction data in reaction to said performance data output, as transferred to said first processor by removable association of said portable medium with said first bi-directional data transfer means; and said portable medium being arranged to be operatively and physically disconnected from said first bi-directional data transfer means when operatively removably associated with any said second bi-directional data transfer means, and to be operationally and physically disconnected from all said second bi-directional data transfer means when operationally removably associated with said first bi-directional data transfer means; and said plurality of stations also having at least one of data storage and comparator means connected to said second processing means.

13. The system of claim 12, wherein:

said at least one of data storage and comparator means is or are arranged for entry of data relative to complementary activities in setting said personalized program.

14. The system of claim 12, wherein:

said at least one of data storage and comparator means is or are arranged for using entry of data relative to exercises performed on apparatus which utilize a plurality of parameters.

15. The system of claim 5, wherein:

said at least one of data storage and comparator means is or are arranged for using, in setting said personalized program, data relative to exercises performed on at least one of isokinetic and cardiovascular apparatus, by manually entering said data in said first processing means.

16. The system of claim 12, wherein:

said at least one of data storage and comparator means are arranged for entry of data relative to exercises performed on at least one of isokinetic and cardiovascular apparatus that do not have data transfer means on the said portable medium.

17. The system of claim 1, wherein:

at least one of said exercise apparatus units is operatively associated with the respective said station and arranged to be electronically programmed by instruction data received as input to the respective said second bi-directional data transfer means from said portable memory, and includes means for detecting at least one variable of exercise interaction with the user from exercise performed by the user at the respective said exercise apparatus unit, for provision as performance output via the respective said bi-directional data transfer means to said portable memory.

18. The system claim 1, wherein:

said portable memory comprises an $E^2$PROM.

19. The system of claim 1, wherein:

said portable medium comprises a waterproof cover enclosing said portable memory; and said portable memory is arranged to be programmed by magnetic induction by said first and second bi-directional data transfer means.

20. The system of claim 1, further including:

a manual data entry means operatively associated with said central unit, for supplying said first processing means, and thereby said first bi-directional data transfer means, with personal and instruction data about said user, for personalizing said personalized program.

21. The system of claim 1, further including:

at least one of said station having operatively associated therewith a manual data entry means, for supplying the respective said second processing means, and thereby the respective said second bi-directional data transfer means, with data about an exercise performed by the user using the respective said exercise apparatus unit.

22. A method for programming and performing training on a plurality of at least one of exercise apparatus units and machines, comprising:

a) creating a personalized program on a central unit equipped with a first data processor for defining a series of routine protocols, each of which is related to a plurality of apparatus protocols correlated to an exercise to be performed on respective ones of said exercise apparatus units and/or machines;

b) transferring one of the routine protocols forming part of the personalized program by a bi-directional data transferor in said central unit, to a portable medium constituting a contact-free data having a portable memory which thereby comes to hold data as to a one of said routine protocols;

c) then transferring one of the said apparatus protocols from said portable medium to a respective one station of a plurality of stations, these stations being independent of one another, by not being connected in a data network, each said station being located at a respective one of said exercise apparatus units and/or machines, each of the said stations being equipped with a second processor and a bi-directional data transferor, said transferring being made from said portable medium to a respective said second processor such that the respective said second processor receives as input the data stored by the portable medium relative to the apparatus protocol to be followed on the respective said apparatus unit or machine and correspondingly programs the respective apparatus unit and/or machine for respective programmed training;

d) the user performing exercise attempting to correspond to the respective programmed training;

e) upon completion of said respective programmed training, trasnferring real data relative to performance of the apparatus protocol correlated to the exercise to the portable memory from the respective said second processor;

f) c) d) and e) for each of a plurality of remaining ones of said exercise apparatus units and/or machines;

g) transferring the real data for the correlated apparatus protocols completed, from the portable memory to the central unit; and h) the central unit processing the real data for all the correlated apparatus protocols completed to obtain processed real data and modifying the personalized program depending on results of said processing, said central unit having a data storage storer connected to said first processor, which stores said processed real data.

23. The method of claim 22, further comprising said data storer.

24. The method of claim 22, further comprising:

storing administrative data in said data storer.

25. The method of claim 22, further comprising:

storing library data in said data storer.

26. A method for programming and performing training on a plurality of at least one of exercise apparatus units and machines, comprising:

a) creating a personalized program on a central unit equipped with a first data processor for defining a series of routine protocols, each of which is related to a plurality of apparatus protocols correlated to an exercise to be performed on respective ones of said exercise apparatus units and/or machines;

b) transferring one of the routine protocols forming part of the personalized program by a bi-directional data transferor in said central unit, to a portable medium constituting a contact-free data having a portable memory which thereby comes to hold data as to a one of said routine protocols;

c) then transferring one of the said apparatus protocols from said portable medium to a respective one station of a plurality of stations, these stations being independent of one another, by not being connected in a data network, each said station being located at a respective one of said exercise apparatus units and/or machines, each of the said stations being equipped with a second processor and a bi-directional data transferor, said transferring being made from said portable medium to a respective said second processor such that the respective said second processor receives as input the data stored by the portable medium relative to the apparatus protocol to be followed on the respective said apparatus unit or machine and correspondingly programs the respective apparatus unit and/or machine for respective programmed training;

d) the user performing exercise attempting to correspond to the respective programmed training;

e) upon completion of said respective programmed training, trasnferring real data relative to performance of the apparatus protocol correlated to the exercise to the portable memory from the respective said second processor;

f) c) d) and e) for each of a plurality of remaining ones of said exercise apparatus units and/or machines;

g) transferring the real data for the correlated apparatus protocols completed, from the portable memory to the central unit; and h) the central unit processing the real data for all the correlated apparatus protocols completed to obtain processed real data and modifying the personalized program depending on results of said processing, said central unit also having at least one of a data storer and a comparator connected to said first processor, which respectively stores and/or compares said processed real data.

27. The method of claim 26, further comprising:

said data storer and/or said comparator using data relative to complementary activities in setting said personalized program.

28. The method of claim 26, further comprising said data storer and/or said comparator, in setting said personalized program, using data relative to exercises performed on apparatus units and/or machines having a plurality of different parameters.

29. A method for programming and performing training on a plurality of at least one of exercise apparatus units and machines, comprising:

a) creating a personalized program on a central unit equipped with a first data processor for defining a series of routine protocols, each of which is related to a plurality of apparatus protocols correlated to an exercise to be performed on respective ones of said exercise apparatus units and/or machines;

b) transferring one of the routine protocols forming part of the personalized program by a bi-directional data transferor in said central unit, to a portable medium constituting a contact-free data having a portable memory which thereby comes to hold data as to a one of said routine protocols;

c) then transferring one of the said apparatus protocols from said portable medium to a respective one station of a plurality of stations, these stations being independent of one another, by not being connected in a data network, each said station being located at a respective one of said exercise apparatus units and/or machines, each of the said stations being equipped with a second processor and a bi-directional data transferor, said transferring being made from said portable medium to a respective said second processor such that the respective said second processor receives as input the data stored by the portable medium relative to the apparatus protocol to be followed on the respective said apparatus unit or machine and correspondingly programs the respective apparatus unit and/or machine for respective programmed training;

d) the user performing exercise attempting to correspond to the respective programmed training;

e) upon completion of said respective programmed training, trasnferring real data relative to performance of the apparatus protocol correlated to the exercise to the portable memory from the respective said second processor;

f) c) d) and e) for each of a plurality of remaining ones of said exercise apparatus units and/or machines;

g) transferring the real data for the correlated apparatus protocols completed, from the portable memory to the central unit; and h) the central unit processing the real data for all the correlated apparatus protocols completed to obtain processed real data and modifying the personalized program each of said stations also having a respective data connected to the respective said second processor, and, in connection with (d) storing data in respective data storer.

30. The method of claim 29, said data storage means are designed to allow the obtaining of data relative to a diet.

31. The method of claim 29, wherein said storing in said respective data storer comprises storing administrative data.

32. The method of claim 29, wherein said storing in said respective data storer comprises storing library data.

33. A method for programming and performing training on a plurality of at least one of exercise apparatus units and machines, comprising:

a) creating a personalized program on a central unit equipped with a first data processor for defining a series of routine protocols, each of which is related to a plurality of apparatus protocols correlated to an exercise to be performed on respective ones of said exercise apparatus units and/or machines;

b) transferring one of the routine protocols forming part of the personalized program by a bi-directional data transferor in said central unit, to a portable medium constituting a contact-free data having a portable memory which thereby comes to hold data as to a one of said routine protocols;

c) then transferring one of the said apparatus protocols from said portable medium to a respective one station of a plurality of stations, these stations being independent of one another, by not being connected in a data network, each said station being located at a respective one of said exercise apparatus units and/or machines, each of the said stations being equipped with a second processor and a bi-directional data transferor, said transferring being made from said portable medium to a respective said second processor such that the respective said second processor receives as input the data stored by the portable medium relative to the apparatus protocol to be followed on the respective said apparatus unit or machine and correspondingly programs the respective apparatus unit and/or machine for respective programmed training;

d) the user performing exercise attempting to correspond to the respective programmed training;

e) upon completion of said respective programmed training, trasnferring real data relative to performance of the apparatus protocol correlated to the exercise to the portable memory from the respective said second processor;

f) c) d) and e) for each of a plurality of remaining ones of said exercise apparatus units and/or machines;

g) transferring the real data for the correlated apparatus protocols completed, from the portable memory to the central unit; and h) the central unit processing the real data for all the correlated apparatus protocols completed to obtain processed real data and modifying the personalized program depending on results of said processing, each of said stations also having at least one of a data storer and comparator connected to the respective said second processor, and, in connection with d), at least one of storing data in the respective said data storer and comparing data by the respective said comparator.

34. The method of claim 33, further comprising:

entering data relative to complementary activities into at least one said data storer and/or at least one said comparator in setting said personalized program.

35. The method of claim 33, further comprising:

entering data relative to exercises performed on at least one apparatus unit and/or at least one machine which utilize a plurality of parameters in setting said personalized program.

36. The method of claim 26, further comprising:

in setting the said personalized program, using data relative to exercises performed on isokinetic and/or cardiovascular apparatus, by manually entering said data in the said first processor.

37. The method of claim 33, further comprising:

entering data relative to exercises performed on isokinetic and/or cardiovascular apparatus, that do not have associated data transferors, onto said portable medium.

38. The method of claim 22, further comprising:

providing said contact-free portable medium so as to include an electrically erasable programmable read-only memory ($E^2$PROM).

39. The method of claim 22, further comprising:

providing said portable medium with a waterproof enclosure containing a memory which is programmable by magnetic induction.

40. A system for programming training on exercise apparatus units and machines, which may be used for training or rehabilitation based on the performance, using a plurality of exercise apparatus units and/or machines, of a series of exercises defining a personalized program, or routine protocol, for a particular person, comprising:

a central unit having a first processing means and a bi-directional data transfer means, arranged to be used to write and read data relative to the personalized program, as well as to modify the personalized program;

a portable medium constituting a contact-free data storage means having a portable memory designed to hold the said data;

a plurality of stations, independent of one another, by being not connected in a data network, said stations being located at respective ones of said plurality of exercise apparatus units and/or machines, having second processing means and means for bi-directional transfer of data from and to the portable medium, so that said stations respectively receive, as input, the data present in the portable memory relative to the exercise to be performed, in order to program the respective apparatus unit and/or machine, and to transfer, as outputs to the portable memory, upon completion of the exercise, real data relative to the exercises and physical effort exerted by the particular person, in order that the real data can be checked;

said central unit first processing means and bi-directional data transfer means being arranged to modify the personalized program in accordance with said real data; and said central unit having data storage and/or comparator means connected to said first processing means.

41. A system for programming training on exercise apparatus units and machines, which may be used for training or rehabilitation based on the performance, using a plurality of exercise apparatus units and/or machines, of a series of exercises defining a personalized program, or routine protocol, for a particular person, comprising:

a central unit having a first processing means and a bi-directional data transfer means, arranged to be used to write and read data relative to the personalized program, as well as to modify the personalized program;

a portable medium constituting a contact-free data storage means having a portable memory designed to hold the said data;

a plurality of stations, independent of one another, by being not connected in a data network, said stations being located at respective ones of said plurality of exercise apparatus units and/or machines, having second processing means and means for bi-directional transfer of data from and to the portable medium, so that said stations respectively receive, as input, the data present in the portable memory relative to the exercise to be performed, in order to program the respective apparatus unit and/or machine, and to transfer, as output, to the portable memory, upon completion of the exercise, real data relative to the exercises and physical effort exerted by the particular person, in order that the real data can be checked;

said central unit first processing means and bi-directional data transfer means being arranged to modify the personalized program in accordance with said real data;

said plurality of stations also having data storage and/or comparator means, connected to respective of said second processing means.

42. A system for programming training on exercise apparatus units and machines, which may be used for training or rehabilitation based on the performance, using a plurality of exercise apparatus units and/or machines, of a series of exercises defining a personalized program, or routine protocol, for a particular person, comprising:

a central unit having first processing means and bi-directional data transfer means, arranged to be used to write and read data relative to the personalized program, as well as to modify the personalized program;

a portable medium constituting a contact-free data storage means having a portable memory designed to hold the said data;

a plurality of stations, independent of one another, by being not connected in a data network, said stations being located at respective ones of said plurality of exercise apparatus units and/or machines, having second processing means and means for bi-directional transfer of data from and to the portable medium, so that said stations respectively receive, as input, the data present in the portable memory relative to the exercise to be performed, in order to program the respective apparatus unit and/or machine, and to transfer, as output, to the portable memory, upon completion of the exercise, real data relative to exercises and physical effort exerted by the particular person in order that the real data can be checked;

said central unit first processing means and bi-directional data transfer means being arranged to modify the personal program in accordance with said real data.

43. A method for programming and performing training on a plurality of at least one of exercise apparatus units and machines, comprising:

a) creating a personalized program on a central unit equipped with a first data processor for defining a series of routine protocols, each of which is related to a plurality of apparatus protocols correlated to an exercise to be performed on respective ones of said exercise apparatus units and/or machines;

b) transferring one of the routine protocols forming part of the personalized program by a bi-directional data transferor in said central unit, to a portable medium constituting a contact-free data having a portable memory which thereby comes to hold data as to a one of said routine protocols;

c) then transferring one of the said apparatus protocols from said portable medium to a respective one station of a plurality of stations, these stations being independent of one another, by not being connected in a data network, each said station being located at a respective one of said exercise apparatus units and/or machines, each of the said stations being equipped with a second processor and a bi-directional data transferor, said transferring being made from said portable medium to a respective said second processor such that the respective said second processor receives as input the data stored by the portable medium relative to the apparatus protocol to be followed on the respective said apparatus unit or machine and correspondingly programs the respective apparatus unit and/or machine for respective programmed training;

d) the user performing exercise attempting to correspond to the respective programmed training;

e) upon completion of said respective programmed training, trasnferring real data relative to performance of the apparatus protocol correlated to the exercise to the portable memory from the respective said second processor;

f) c) d) and e) for each of a plurality of remaining ones of said exercise apparatus units and/or machines;

g) transferring the real data for the correlated apparatus protocols completed, from the portable memory to the central unit; and h) the central unit processing the real data for all the correlated apparatus protocols completed to obtain processed real data and modifying the personalized program depending on results of said processing.

44. A system for programming training on exercise apparatus units and machines, which may be used for training or rehabilitation based on the performance, using a plurality of exercise apparatus units and/or machines, of a series of exercises defining a personalized program, comprising:

a central unit having a first processing means and a bi-directional data transfer means, arranged to be used to write and read data relative to the personalized program, as well as to modify the personalized program;

a portable medium having a portable memory for the storage of the said data;

a plurality of stations, said stations being located at respective ones of said plurality of exercise apparatus units and/or machines, having second processing means and means for bi-directional transfer of data from and to the portable medium, so that said stations respectively receive, as input, the data present in the portable memory relative to the exercise to be performed, in order to program the respective apparatus unit and/or machine, and to transfer, as output, to the portable memory, upon completion of the exercise, data relative to exercises and physical effort exerted by a respective user in order that the exercises and physical effort can be controlled; and said central unit first processing means and bi-directional data transfer means being arranged to modify the personalized program in accordance with said data.

* * * * *

UNITED STATES PATENT AND TRADEMARK OFFICE

CERTIFICATE OF CORRECTION

PATENT NO. : 5,931,763

DATED : August 3, 1999

INVENTOR(S) : Alessandri

It is certified that error appears in the above-identified patent and that said Letters Patent is hereby corrected as shown below:

On the Title Page, Item [63]:

Change "[63] Continuation-in-part of application no. 08/539,408, Oct. 5, 1995, Pat. No. 5,782,720" to --[63] Continuation-in-part of application no. 08/539,408, Oct. 5, 1995, Pat. No. 5,916,063--

Signed and Sealed this

Third Day of April, 2001

*Attest:*

Nicholas P. Godici

NICHOLAS P. GODICI

*Attesting Officer*

*Acting Director of the United States Patent and Trademark Office*